United States Patent [19]

Gardner et al.

[11] 4,337,031

[45] Jun. 29, 1982

[54] PREHEATING APPARATUS

[75] Inventors: Kenneth L. Gardner, Riverside; William E. Zimmer; Samuel A. Miller, both of Danville, all of Pa.

[73] Assignee: Kennedy Van Saun Corporation, Danville, Pa.

[21] Appl. No.: 230,730

[22] Filed: Feb. 2, 1981

[51] Int. Cl.[3] ..... F27D 1/08; F27B 7/02; F26B 17/12

[52] U.S. Cl. ..... 432/98; 34/170; 432/102; 432/106

[58] Field of Search ..... 432/17, 98, 102, 106; 34/170

[56] References Cited

U.S. PATENT DOCUMENTS

| | | | |
|---|---|---|---|
| 2,275,442 | 3/1942 | Kennedy | 34/170 |
| 3,601,376 | 8/1971 | Niemitz | 432/17 |
| 4,207,061 | 6/1980 | Ikenaga | 432/102 |

*Primary Examiner*—John J. Camby
*Attorney, Agent, or Firm*—Brumbaugh, Graves, Donohue & Raymond

[57] ABSTRACT

An apparatus for preheating particulate material in which the particulate material is transferred from an upper storage bin to a lower annular flow passage by a plurality of connecting chutes and the particulate material is preheated in the annular flow passage by hot kiln gases flowing in countercurrent heat exchange relationship with the particulate material and, in addition, by hot kiln gases introduced into the annular flow passage from the lower regions of radially extending ducts.

6 Claims, 6 Drawing Figures

PREHEATING APPARATUS

This invention relates to a method and apparatus for preheating particulate material and, more particularly, to an improved method and apparatus for preheating particulate material more uniformly and more efficiently than has heretofore been possible in conventional methods and apparatus.

Although the present invention is applicable generally to the preheating of particulate material, it is particularly applicable to the preheating and precalcining of limestone by flowing the limestone and the hot kiln gases from the calcining kiln in countercurrent heat exchange relationship to each other. The preheating apparatus of this general type are known and are described in prior art patents, among them U.S. Pat. Nos. 3,601,376, 3,832,128 and 3,903,612, and the prior art discussed and cited therein.

In the conventional prior art apparatus for preheating and precalcining limestone, the limestone is supplied to an overhead storage bin and directed downwardly through an annular preheating and precalcining passage to a central discharge while flowing the hot kiln gases in countercurrent heat exchange relation through at least the lower region of the annular preheating and precalcining passage before exhausting the hot kiln gases from the preheating apparatus. In these preheating apparatus the hot kiln gases tend to follow the paths of least resistance, namely, the shortest path from the source of the hot gases across the annular flow of the limestone towards the gas exhaust. This shortest path does not uniformly distribute the gases through the annular flow of the limestone.

In the preheating method and apparatus of the present invention the hot kiln gases not only flow upwardly in countercurrent heat exchange relationship through substantially the entire length of the annular preheating and precalcining flow passage but, in addition, some of the hot kiln gases are introduced directly into radially extending ducts which discharge the hot gases from the lower regions of the ducts substantially throughout the radial extent of the annular flow passage to cause the hot gases to flow outwardly around and on opposite sides of the ducts and then in countercurrent direction to the particulate material flowing on opposite sides of the ducts. The preheating method and apparatus achieves more uniform preheating and precalcining of the particulate material. In addition, since the hot kiln gases flow directly into the radially extending ducts without passage through the limestone, greater efficiency of operation is achieved due to the substantial reduction in the resistance to the flow of the hot kiln gases and the reduction in the power supply necessary to induce the flow of the hot kiln gases through the preheating apparatus.

Other novel features of the preheating method and apparatus of the present invention include the modular construction of the apparatus, and particularly the lower preheating and precalcining section thereof, the provision of a plurality of chutes arranged in an annular array to provide a gaseous fluid barrier between the upper storage bin and the lower preheater and precalciner and the structure of the radially extending hot kiln gas ducts and the cooling means therefor.

For a complete understanding of the present invention, reference can be made to the detailed description which follows and to the accompanying drawings, in which.

Figure 4:
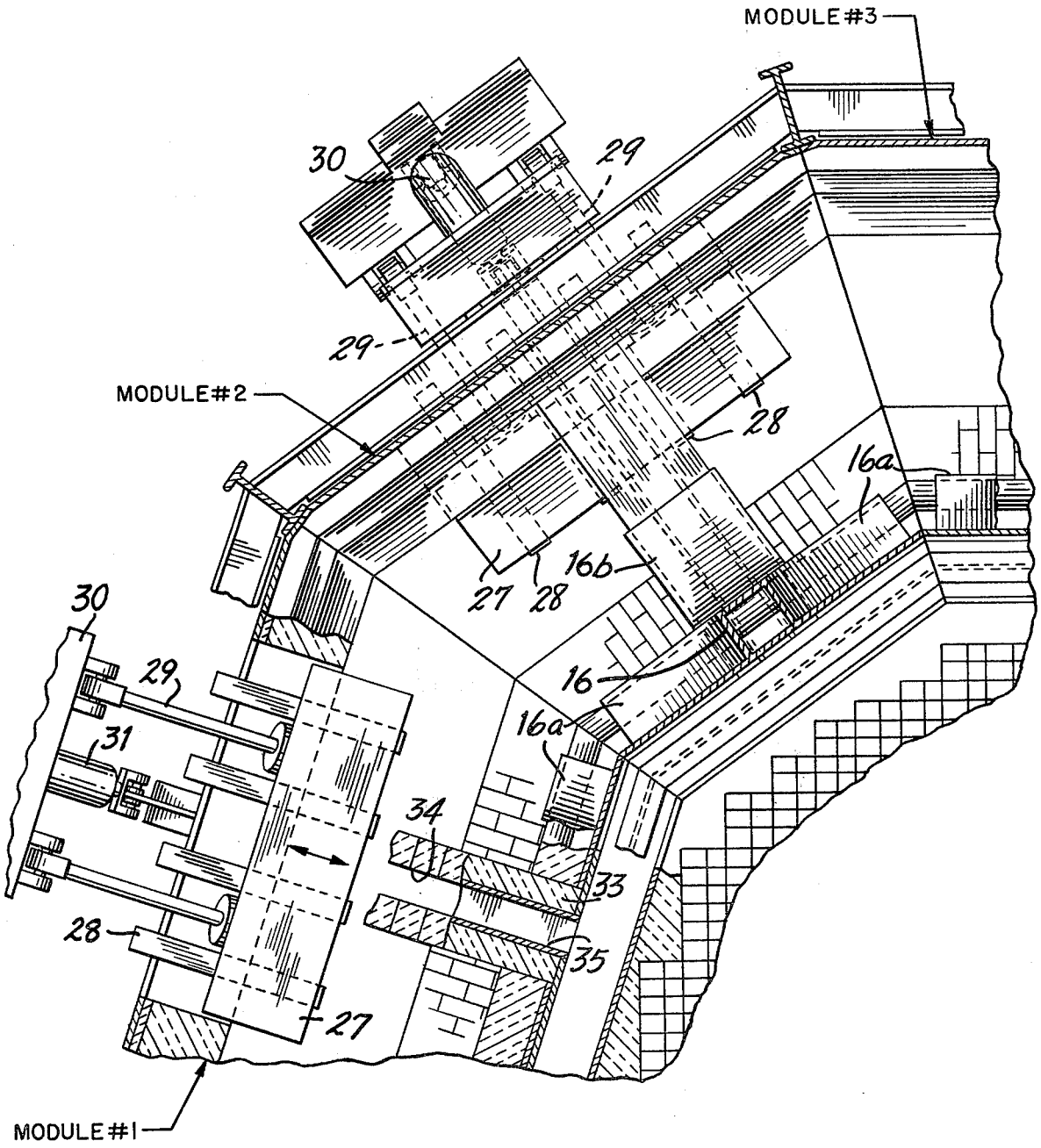
Figure 5:
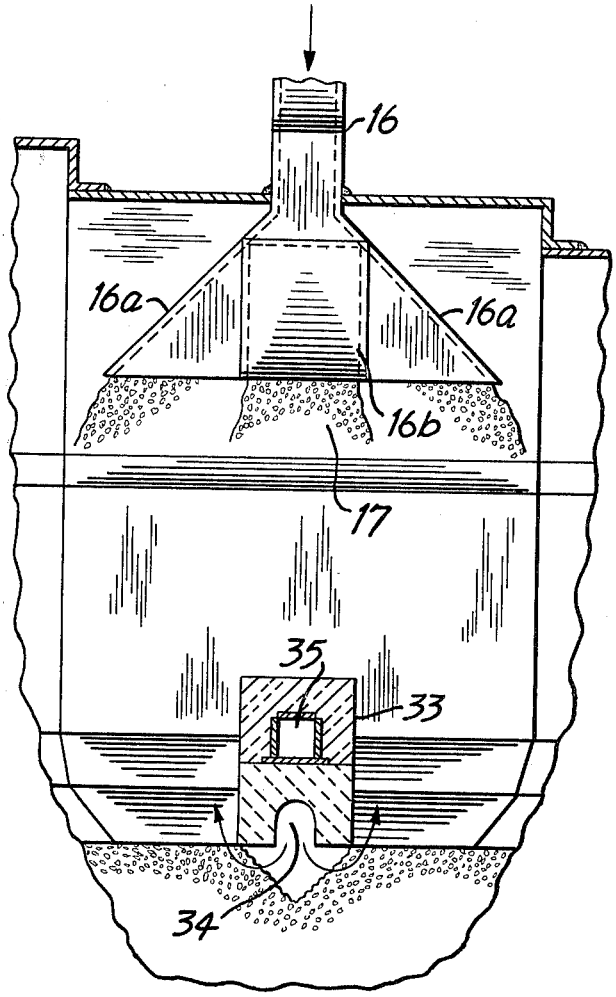
Figure 6:
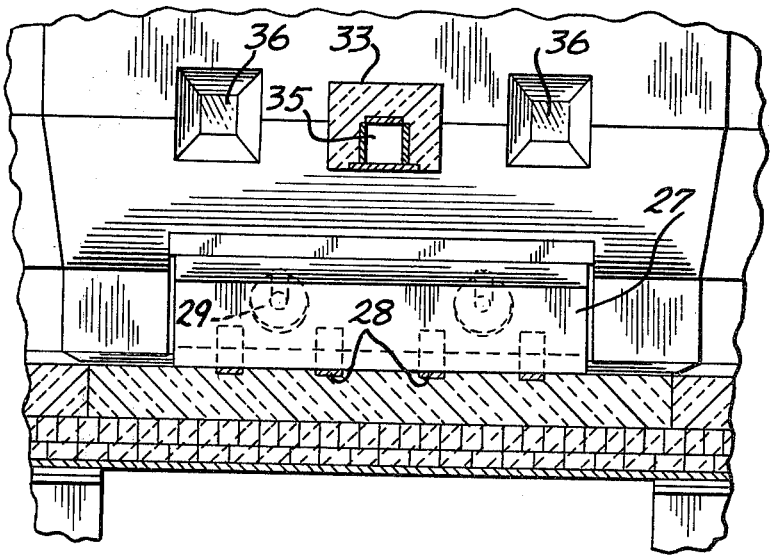

FIG. 4 is a broken-away fragmentary plan view in cross-section of a portion of the preheater of the present invention; and FIGS. 5 and 6 are cross-sectional views taken along the lines 5—5 and 6—6, respectively, looking in the direction of the arrows.

The apparatus for preheating and precalcining limestone includes an upright modular structure 10 having an upper centrally located inlet 11 into which the limestone is fed and a lower centrally located discharge 12 which communicates through a transfer conduit 13 with a rotary kiln 14. The limestone introduced through the inlet 11 is discharged into a storage bin accommodated in the upper region of the preheater, and it is fed through chutes 16 into an annular preheater and precalciner 17 in the lower region of the preheater. As the limestone flows downwardly within the preheater and precalciner 17 towards the discharge 12, hot kiln gases from the kiln flow in countercurrent direction to preheat and precalcine the limestone prior to its discharge and its introduction into the kiln.

The storage bin 15 in the upper region of the preheater is defined by an overhead roof 18, a central conical formation having an upper surface 19 which extends downwardly and outwardly and an outer downwardly and inwardly extending surface 20 which cooperates with the sloped surface 19 to form a downwardly tapered flow passage from the storage bin to the chutes 16. The limestone within the storage bin is directed outwardly to the annular flow passage, and it then passes through the chutes 16 to the annular preheater and precalciner 17 in the lower region of the preheater.

The annular preheater and precalciner is essentially a plurality of modular components assembled to form an annular flow passage from the lower ends of the chutes 16 to the preheater discharge 12 composed of a stepped roof 21 and inner and outer walls 22, 23 above a sloped floor 24. The limestone discharged from the lower ends of the chutes flows through the annular preheater and precalciner to the sloped floor 24 and then out the discharge 12 through which it is delivered to the kiln. In flowing downwardly through the annular preheater and precalciner, the limestone is preheated and precalcined by the countercurrent flow of the hot kiln gases which flow upwardly through the limestone to the air bustle 25 above the limestone in the upper, outer region of the preheater and precalciner. The air bustle regions 25 of the modules are connected to form a hot gas discharge duct which communicates with a pair of exhaust passages 26 through which the kiln gases are discharged by an induced draft fan (not shown) which directs the hot gases to a dust collector.

The lower ends of the chutes 16 have downwardly and laterally extending diagonal walls **16*a* and a downwardly and outwardly extending diagonal wall 16*b* which permit the limestone to spread outwardly as it is discharged into the upper, inner region of the annular preheater and precalciner. The outwardly extending diagonal walls 16*a* and 16*b*** distribute the particulate matter such that a more uniform countercurrent path length for the hot gas is insured.

Figure 1:
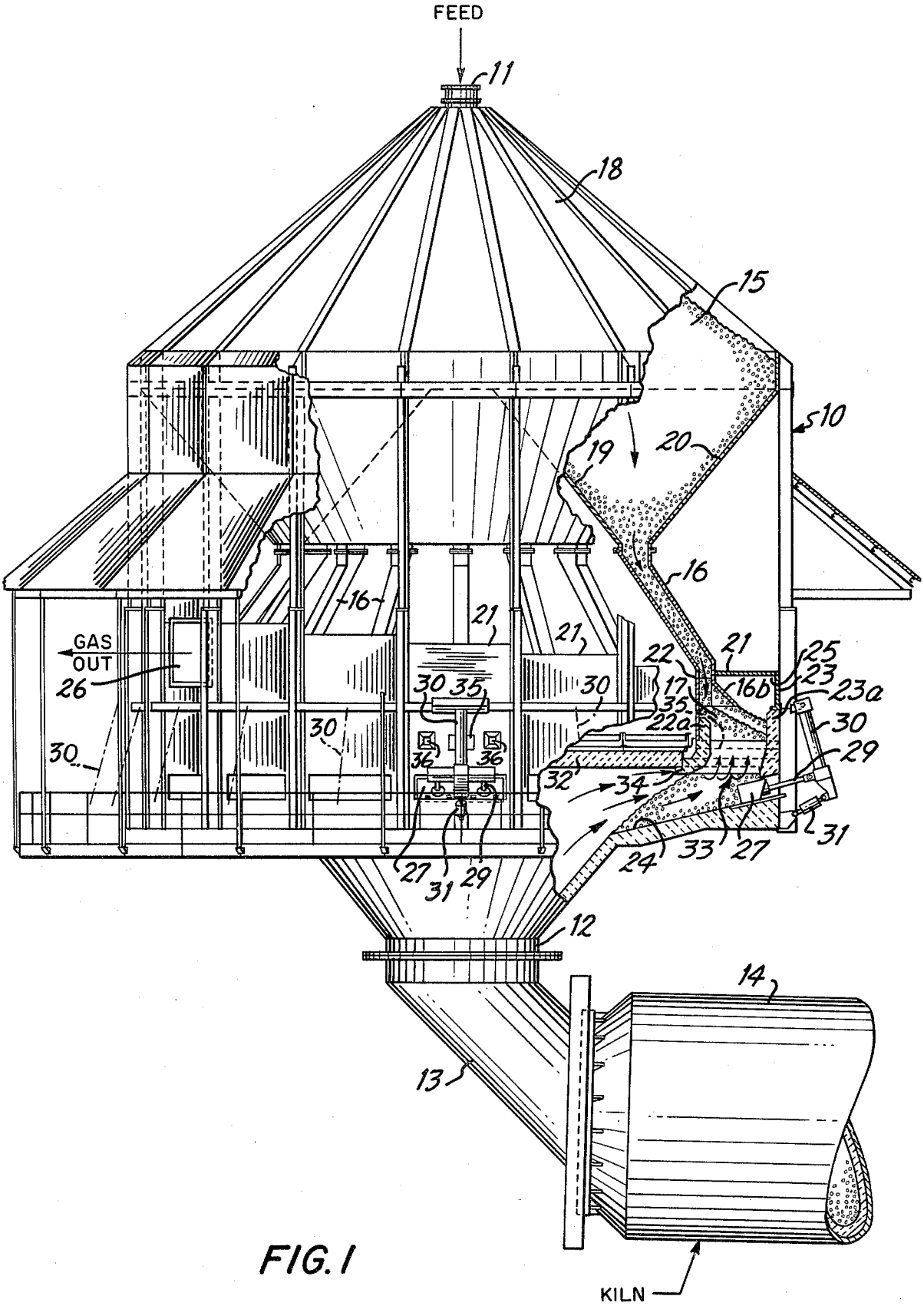
FIG. 1 is an elevational view of the preheater of the present invention shown partly in cross-section and with portions of the exterior wall broken away.
Figure 2:
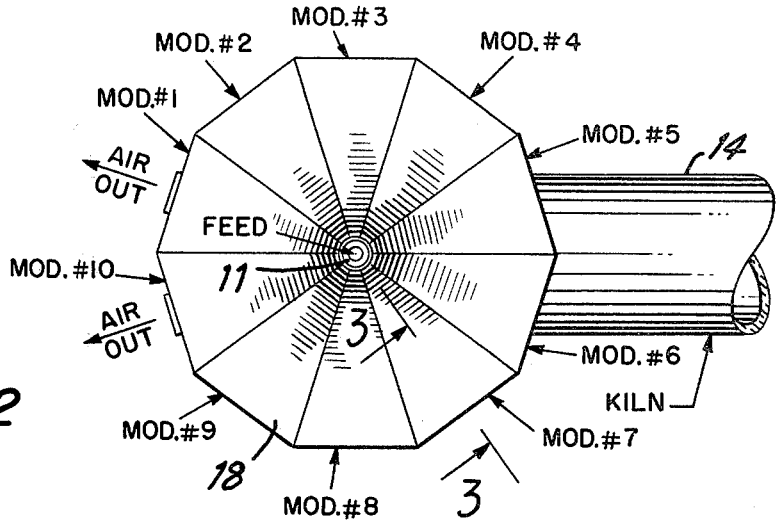
FIG. 2 is a top plan view of the preheater shown in FIG. 1.
Figure 3:
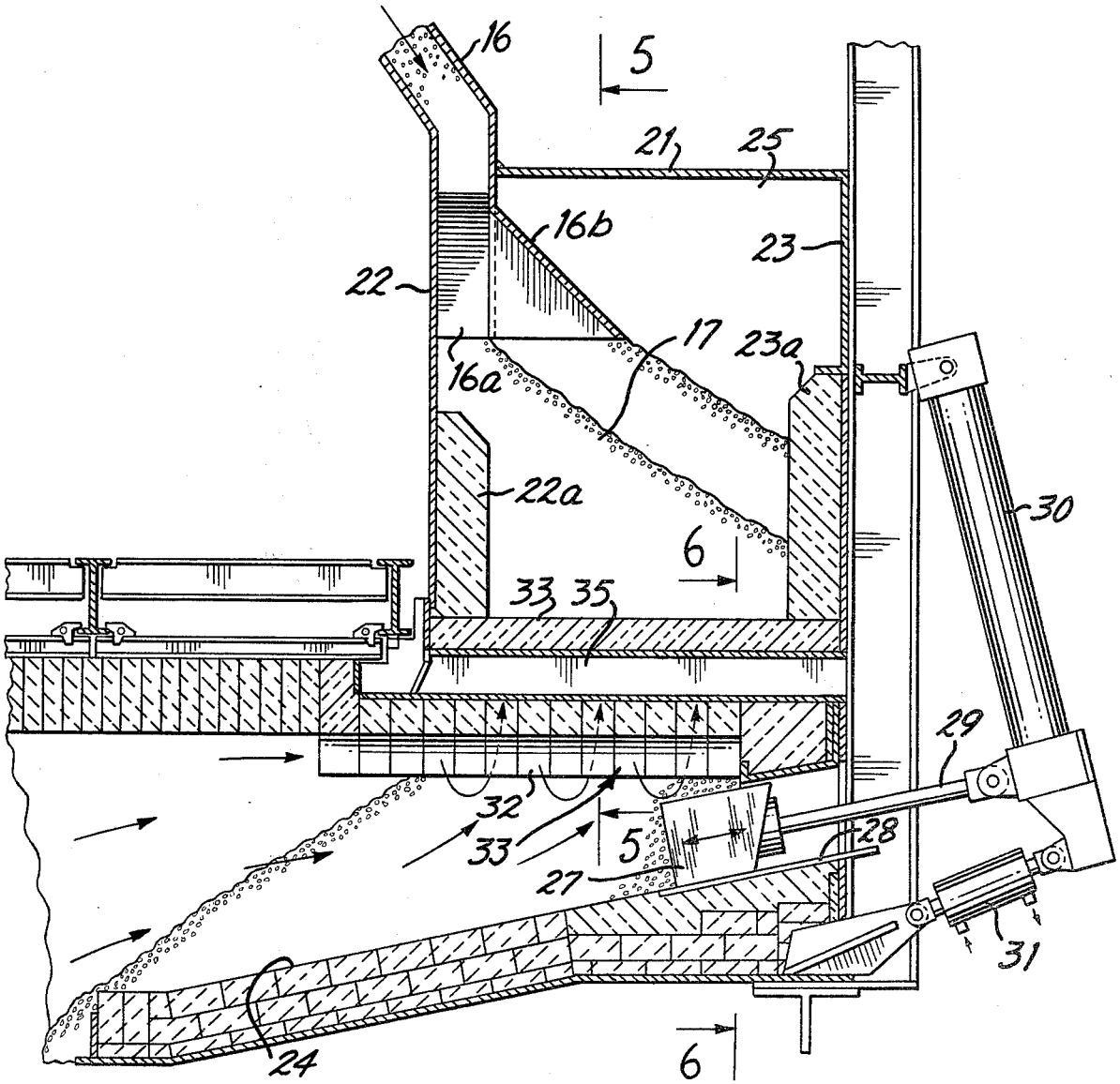
FIG. 3 is a sectional view taken along the line 3—3 of FIG. 2 looking in the direction of the arrows.

The preheating apparatus of the present invention can be a cylindrical structure, but for ease of construction and economy it is preferably a modular construction which, in the embodiment shown in the drawings, is made up of ten modules, designated #1 through 10 in FIG. 2 of the drawings. Similarly, the annular preheater and precalciner section 17 thereof can also be a cylindrical construction, that is to say, the inner and outer walls 22 and 23, respectively, can be cylindrical in shape, but in the preferred embodiment shown in the drawings they are polygonal in shape.

Since the hot kiln gases flow upwardly through all of the modules of the annular preheater and precalciner to the exhaust duct formed by the connected air bustles 25, the air bustle regions 25 of the modules must increase in volume progressively from the modules more remote from the exhausts 26 to the modules containing the exhausts. This is accomplished by stepping the roof 21 upwardly from the modules #5 and #6 located remotely from the exhausts 26 to the modules #1 and #10 which contain the exhausts.

The chutes 16 form an effective gaseous fluid barrier between the storage bin 15 and the annular preheater and precalciner 17. Because they are relatively long in relation to their cross-sectional areas and completely filled with limestone, they are effective in preventing the flow of ambient air from the storage bin to the preheater and precalciner.

The preheated and precalcined limestone is discharged uniformly from the discharge 12 by the reciprocatory motion of a plurality of plunger feeders 27 actuated in a predetermined sequence. These plunger feeders, generally of the type described in the Niemitz U.S. Pat. No. 3,601,376, are of relatively wide dimension and are supported on rails 28 of the sloped floor 24. The plunger feeders are connected by rods 29 to actuators 30 pivotally mounted at their upper ends and reciprocated at their lower ends by hydraulic rams or cylinders 31. The length of stroke of each plunger feeder 27 can be individually controlled by limit switches (not shown) and the sequence of operation is electronically controlled. When a hydraulic cylinder or ram is pressured the corresponding plunger feeder moves inwardly, pushing the preheated and precalcined limestone through the discharge 12 for transfer through the chute 13 to the rotary kiln 14.

The principal objective of the preheater and precalciner of the present invention is to effectively use the countercurrent flow of the kiln gases to preheat and precalcine the limestone more uniformly and more effectively. Toward this end, the preheater apparatus has an insulated wall 32 lined wth refactory material spaced above the funnel-shaped discharge 12 to direct the hot kiln gases outwardly through the annular passage defined between the sloped floor 24 and insulated wall 32 and then upwardly through the annular flow passage 17 of the preheater and calciner to the air bustle or duct 25 for ultimate discharge through the exhaust outlets 26. Since this countercurrent flow of exhaust gases will tend to take the shortest path of least resistance through the limestone, provision is herein made for more widely distributing the flow so that more uniform preheating and precalcining will be achieved. In order to distribute the flow of hot kiln gases more widely and uniformly across the annular flow passage 17 from the inner wall 22 to the outer wall 23 thereof, a plurality of radially extending insulated walls 33 is provided in the annular flow passage 17 in the path of the limestone so that the limestone flows downwardly on opposite sides of the walls. Each of the walls 33 has formed therein a radially extending duct channel 34 in open communication at the bottom of the wall with the flow passage 17. The hot gas duct channels 34 are in open communication at their inner ends with the hot kiln gases above the limestone fed by the plunger feeders 27 across the sloped floor 24, and the hot kiln gases flow unimpeded directly into the radially extending duct channels 34 from which they are released into the limestone across the full extent of the flow passage between the inner and outer walls 22,23 thereof. The hot gases flow downwardly and then outwardly on opposite sides of the walls 33 and then upwardly through the limestone to achieve a more uniform flow distribution.

Because of the high temperature in the annular flow passage and even though the walls 33 are insulated by refractory material, the walls 33 are preferably cooled by air passages 35 above the duct channels 34 which admit ambient air through their outer ends and discharge it into the hollow central region of the preheater an precalciner apparatus. Observation ports 36 are provided in the outer wall of the apparatus to permit inspection of the interior of the preheater and precalciner.

The sloped floor 24, the wall 32, the radially extending walls 33 and the lower regions 22*a* and 23*a* of the walls 22 and 23, respectively, are all insulated by refractory materials for a more efficient preheating and precalcining operation.

The improved distribution of the hot kiln gases made possible by the radially extending duct channels 34 affords a more uniformly preheated and precalcined limestone product. In addition, the resistance to the flow of the hot gases is appreciably decreased, providing a pressure drop in the order of about 40% lower than a preheater of the construction shown and described in the Niemitz patent indentified above, so that considerably less energy is required to induce the flow of the hot kiln gases through the preheater and precalciner.

The invention has been shown in a single preferred form and by way of example only, and many variations and modifications can be made therein within the spirit of the invention. The invention, therefore, should not be limited to any specified form or embodiment except in so far as such limitations are expressly set forth in the claims.

We claim:

1. A preheating apparatus for particulate material comprising an annular flow passage for the particulate material having a lower discharge, an annular sloped surface forming the lower end of the annular flow passage across which the material moves toward said lower discharge, means for moving the material across the sloped surface toward said discharge, means for introducing hot kiln gases into the lower region of said annular flow passage above the sloped surface for flow in countercurrent heat exchange relationship with the particulate material, a plurality of hot kiln gas ducts extending radially across said annular flow passage and communicating at their inner ends with the hot kiln gases above the material moving across the sloped floor and extending substantially across the annular flow passage above the means for moving the material across the sloped surface and means for discharging the hot kiln gases from the lower regions of the radially extending ducts substantially throughout the radial lengths thereof to cause the hot kiln gases to flow outwardly around the radially extending ducts and then in countercurrent direction to the particulate material.

2. A preheating apparatus for particulate material comprising an annular flow passage for the particulate material having a lower discharge, means for introducing hot kiln gases into the lower region of said annular flow passage for flow in countercurrent heat exchange relationship with the particulate material, a plurality of hot kiln gas ducts extending radially across said annular flow passage and communicating with the hot kiln gases at their inner ends and means for discharging the hot kiln gases from the lower regions of the radially extending ducts substantially throughout the radial lengths thereof to cause the hot kiln gases to flow outwardly around the radially extending ducts and then in countercurrent direction to the particulate material, and radially extending ducts including an insulated radially extending wall across the annular flow passage, and said means for discharging the hot kiln gases including an open channel extending continuously along the bottom of said wall and communicating at its inner end with the hot kiln gases and discharging them from the channel so that they flow outwardly and then upwardly around the sides of the wall in countercurrent heat exchange relationship to the particulate material flowing downwardly on opposite sides of said wall.

3. A preheating apparatus as set forth in claim 2 including a passage through said wall above the channel for the flow of ambient cooling air towards the interior of the preheating apparatus.

4. A preheating apparatus for particulate material comprising an annular flow passage for the particulate material having a lower discharge, means for introducing hot kiln gases into the lower region of said annular flow passage for flow in countercurrent heat exchange relationship with the particulate material, a plurality of hot kiln gas ducts extending radially across said annular flow passage and communicating with the hot kiln gases at their inner ends, a radially extending wall accommodating each of the hot kiln gases ducts, means for discharging the hot kiln gases from the lower regions of the radially extending ducts substantially throughout the radial lengths thereof to cause the hot kiln gases to flow outwardly around the radially extending ducts and then in countercurrent direction to the particulate material, and means for forming a passage through said radially extending wall and in communication with a cooling fluid to bring the cooling fluid in heat exchange relationship with the radially extending wall.

5. A preheating apparatus for particulate material comprising a plurality of modules, each having inner and outer walls and a roof and cooperating to define an annular flow passage for the particulate material, a lower discharge from the annular flow passage to the kiln, means for introducing hot kiln gases into the lower region of said annular flow passage for flow in countercurrent heat exchange relationship with the particulate material, a hot kiln gas exhaust in the upper region of the outer wall of at least one of the modules, an outer region of each module forming an air bustle, the connected air bustles forming a discharge duct for the hot kiln gases, and in which the roofs and heights of the modules are stepped upwardly from a more remote module in communication with the hot kiln exhaust to the module containing the hot kiln exhaust, thereby forming a hot kiln duct of progressively greater volume, a plurality of hot kiln gas ducts extending radially across said annular flow passage and communicating with the hot kiln gases at their inner ends and means for discharging the hot kiln gases from the lower regions of the radially extending ducts substantially throughout the radial lengths thereof to cause the hot kiln gases to flow outwardly around the radially extending ducts and then in countercurrent direction to the particulate material.

6. A preheating apparatus for particulate material comprising an annular flow passage for the particulate material having a lower discharge, means for introducing hot kiln gases into the lower region of said annular flow passage for flow in countercurrent heat exchange relationship with the particulate material, a storge bin above the annular flow passage for the particulate material, a plurality of chutes connecting the lower discharge end of the storage bin with the upper region of the annular flow passage to feed the particulate material from the storage bin to the annular flow passage and to provide a gaseous fluid barrier therebetween, the lower discharge ends of the chutes communicating with the upper inner region of the annular flow passage, a plurality of hot kiln gas ducts extending radially across said annular flow passage and communicating with the hot kiln gases at their inner ends, means for discharging the hot kiln gases from the lower regions of the radially extending ducts substantially throughout the radial lengths thereof to cause the hot kiln gases to flow outwardly around the radially extending ducts and then in countercurrent direction to the flow of particulate material, a discharge from a hot gas kiln duct in the upper outer region of the annular flow passage, and downwardly and outwardly extending diagonal walls extending from the outer lower ends of the chutes which help distribute the particulate matter such that a more uniform countercurrent path length for the hot gas is insured.

* * * * *